United States Patent [19]

Turnage

[11] 3,946,866

[45] Mar. 30, 1976

[54] CONE NOSE PROTECTOR

[75] Inventor: Richard W. Turnage, Hartsville, S.C.

[73] Assignee: Sonoco Products Company, Hartsville, S.C.

[22] Filed: Sept. 3, 1974

[21] Appl. No.: 502,605

[52] U.S. Cl. ..... 206/392; 206/413; 242/68.6

[51] Int. Cl.[2] ..... B65D 71/00

[58] Field of Search ..... 206/413, 414, 415, 392, 206/389, 416; 138/96 T; 242/68.6

[56] References Cited

UNITED STATES PATENTS

| | | | |
|---|---|---|---|
| 2,699,866 | 1/1955 | Russell, Jr. | 206/392 |
| 2,704,600 | 3/1955 | Despres | 206/392 |
| 2,876,898 | 3/1959 | Schmidt | 206/392 |
| 3,624,776 | 11/1971 | Gordon | 206/392 |
| 3,730,340 | 5/1973 | Neubert | 206/392 |

*Primary Examiner*—William T. Dixson, Jr.
*Attorney, Agent, or Firm*—Dennison, Dennison, Meserole & Pollack

[57] ABSTRACT

A protector for the nose of a yarn cone having conical sides connecting an inner cup with a hemitoroidal portion such that the protector fits over the nose of the cone and prevents damage thereto.

8 Claims, 6 Drawing Figures

CONE NOSE PROTECTOR

BACKGROUND

For many years packages of yarn which are wound on cones or bobbins have been packaged in corrugated cartons for shipping from one location to another. There has long been a problem to the textile industry in packaging the yarn in such containers because of the yarn package weight and potential damage to the yarn by movement. A further substantial problem that has existed is that during the take off or delivery of the yarn from the cone it is essential that the nose of the cone be in good condition. Because of the past methods of packaging the yarn for shipment there has been substantial damage to the nose of the cone.

Various attempts have been made to remedy and solve the problem of cone nose damage and yarn package damage during the shipment. For example, the patent to Paffen, et al., U.S. Pat. No. 2,646,166 shows an article used to separate the yarn packages in a carton and to hold them substantially rigid. Similarly the patent to Schmidt U.S. Pat. No. 2,876,898 shows a protective separator for cones or bobbins to be packaged in a carton. Each of these prior devices requires that the yarn packages be separated into a prearranged alignment and each provides a flange for fitting within the bottom of one cone and onto the nose of the cone which would be located therebelow in the carton. Thus, neither of these patents provides the protection for the cone nose to prevent damage thereto and permit the smooth delivery of yarn from the cone during processing. Furthermore, many of the previously known packaging devices cause the damage to the nose of the cone.

A further problem that has been encountered in the textile industry is that during the winding of yarn on the cone or bobbin, it is attempted to have uniform packages of a given amount of yarn or weight of package. Unfortunately, in many instances, the yarn will break prior to completion of the package. Because of the complexity of the machines and the time involved in rethreading and tying the yarn, as well as a need to avoid knots in the yarn, it has been found expeditious and proper to merely ship yarn packages which are of less than the full size. This arrangement causes a considerable waste of space in shipping containers where there is a predetermined arrangement for the yarn packages. A random disposal of the packages permits the yarn packages to be packed into the containers in a much more economical arrangement by permitting several of the smaller packages to be included with larger packages. This avoids the wasted space which would result from a predetermined spacing arrangement as set forth in the noted prior art patents. Some textile manufacturers having recently placed the yarn packages in the shipping containers in a completely at random manner. That is, the packages are not necessarily shipped in an upright position, but are placed in the shipping container on the side, upside down, upright or as they fall into the container.

In order to overcome the above disadvantages, the instant concept utilizes a conical side portion connected to an inner cup by a hemitoroidal portion such that the conical side portion overlys, i.e., contacts the outer surface of the cone nose and the hemitoroidal portion fits over, i.e., is spaced above the axial end of the cone such that the inner cup portion will hold the protector in place and the complete cone nose is protected. A flange may extend outwardly from the side of the conical side portion to provide rigidity since the protector does not have to be of substantial strength. This construction permits a random disposal of the yarn packages which may be of varying sizes and stacking of yarn packages in the shipping containers.

DESCRIPTION

Reference is now made to the drawings wherein like numerals refer to similar elements throughout and in which.

Figure 1:
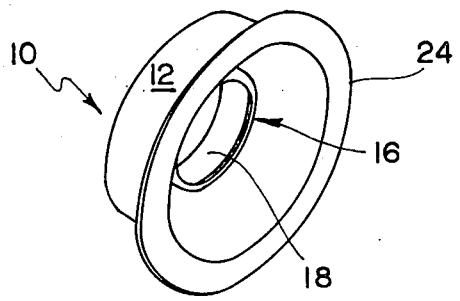
FIG. 1 is an isometric view of a cone nose protector of the instant invention.
Figure 2:
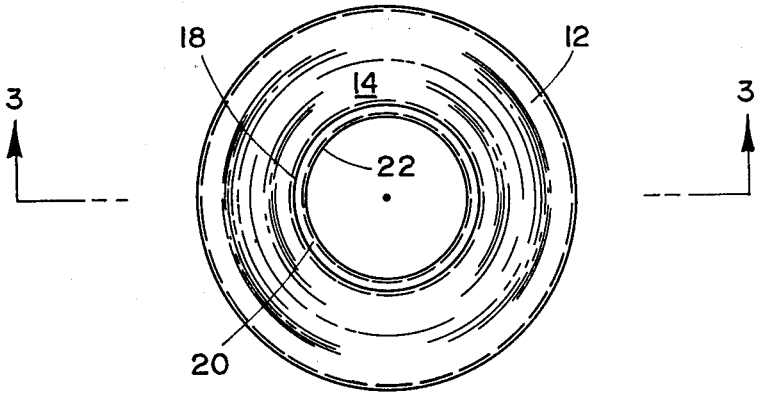
FIG. 2 is a top view of the instant invention.
Figure 3:
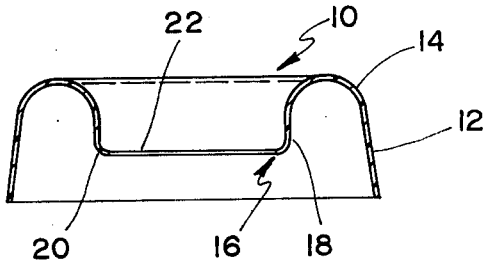
FIG. 3 is a side cross-sectional view taken on Line 3—3 of FIG. 2.

Referring now to FIGS. 1–3 wherein cone nose protector 10 is shown to include conical side portion 12 connected by hemitoroidal portion 14 to inner cup 16. Inner cup 16 includes substantially cylindrical side portion 18 and bottom 20. Bottom 20 has central opening 22 which permits trapped air to flow from the interior of the cone, as well as providing a resiliency to protector 10 to permit a firm attachment of the protector to the nose of a cone. A reinforcement flange 24 may extend outwardly from conical side portion 12 to provide rigidity to the overall protector and provide a means of removing the cone nose protector 10 at the point of use and after protection of the cone nose is unnecessary. However, it is to be understood that generally flange 24 is omitted to provide protector 10 with a smooth configuration which permits the protector to remain in place during delivery of the yarn from cone 30.

Figure 4:
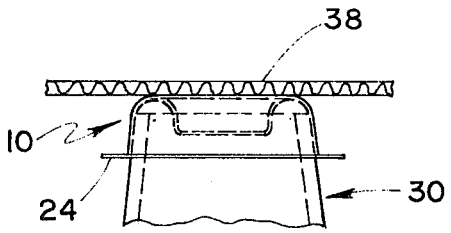
FIG. 4 shows an enlarged diagramatic side view, partially in section, of the instant invention as applied to a cone with a package separator in place.

FIG. 4 diagramatically shows cone 30 having protector 10 positioned thereon with the hemitoroidal portion 14 spaced above the axial end of the cone 30 the shipping container layer separator 38 in the approximate location it would assume with reference to the yarn package during shipment. Separator 38 may be of corrugated paperboard or any other material as is well known in the textile industry for this type of shipping container.

Figure 5:
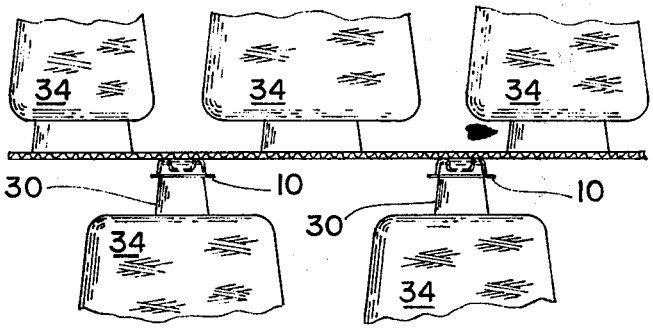
FIG. 5 shows a partial side view of a shipping container incorporating the instant invention.
Figure 6:
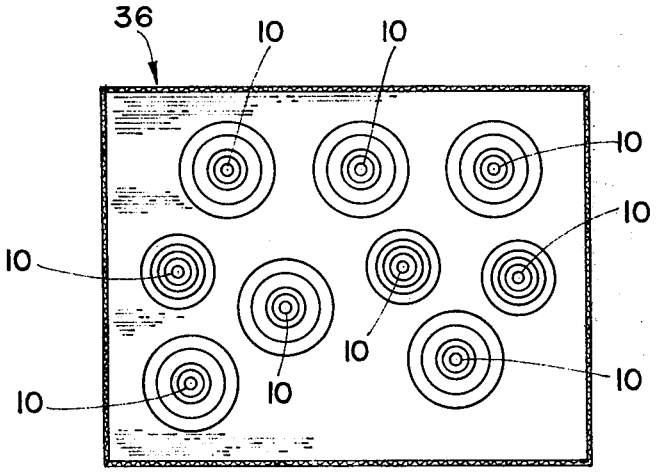
FIG. 6 shows a diagramatic plan view of a shipping container with the yarn packages randomly disposed.

FIG. 5 shows several yarn packages 34 wound on cones 30 with protector 10 properly positioned to protect cone nose 32. A plan view of shipping container 36 is shown in FIG. 6 wherein yarn packages 34 are randomly positioned to effectively utilize the complete space within shipping container 36.

Cone nose protector 10 may be made of any easily formable material. Thermoforming of plastic such as vinyl, polystyrene and polyethylene is considered to be the best method for manufacture of protector 10. It is to be noted that vinyl is an excellent material for the embodiment without flange 24 as it provides a protector more difficult to remove and thus remains on the cone during removal of the yarn therefrom. Although vacuum forming has been found to be a preferable method of forming the cone nose protector, it is to be understood that injection molding of the protectors may provide more efficient and economical production for some embodiments of the protector. However, it has been found that thin, lightweight, high density polyethylene which has been vacuumed formed is an excellent embodiment and provides substantial protection for the yarn package. For example, in drop tests conducted from heights of 1, 3 and 5 feet a shipping carton incorporating the cone nose protectors of the instant invention was compared with an identical carton of cones without the protector. The weight of each of the cartons was approximately 215 pounds. The results of this test are set forth below.

| Height of Drop | Damages Noses Protected | Damages Noses Controlled |
|---|---|---|
| 1 ft. | 0 | 0 |
| 3 ft. | 0 | 25 (40.32%) |
| 5 ft. | 4 (7%) | (Test not performed due to large number of failures at 3 ft.) |

It is possible to continue with a yarn identification system similar to that currently in use when utilizing a cone nose protector by either forming the protector from colored plastic material or coating the protector with a paint or dye.

Thus it is seen that the instant invention provides a means of protecting the individual cones or yarn packages while permitting the various sized packages to be positioned in a shiping container in a most efficient manner. The weight of the upper packages can be borne on the protected nose cone without damage thereto and proper yarn delivery from the cone at the time of use is permitted. The protector is easily applied and is capable of multiple uses while being of lightweight and, therefore, reduces shipping costs. The protector permits the separation of the yarn packages, as well as the utilization of varying sized shipping containers.

What is claimed as new is:

1. A protector for the nose of a cone comprising:

a conical side portion wherein one end is of smaller diameter than the other end;

a hemitoroidal portion extending from said smaller end portion and inwardly thereof;

said conical side portion being adapted to space said hemitoroidal portion above the axial end of the nose of the cone whereby said conical side portion is adapted to interfit with and be held by the nose of the cone to provide protection thereof with said hemitoroidal portion spaced above the axial end of the cone.

2. The nose cone protector of claim 1 including an inner cup extending downwardly into said conical side portion.

3. In the cone nose protector of claim 2 said inner cup having an opening in said bottom.

4. The cone nose protector of claim 1 including a flange extending outwardly from said other end of said conical side portion.

5. The cone nose protector of claim 1 having identification means for the package to which the protector is attached.

6. A shipping container for packages of yarn wound on conical members comprising:

a container having sides and a bottom;

a plurality of yarn packages wound on cones and randomly disposed in said container;

nose cone protectors on the nose of said cones;

said nose protectors having a conical side portion wherein one end is of smaller diameter than the other end and a hemitoroidal portion extending from said smaller end portion and inwardly thereof to provide resilient attachment of said protector to the nose of said cone; and said conical side being adapted to space said hemitoroidal portion above the axial end of the nose of said cone.

7. The combination of claim 6 wherein said nose cone protectors have an inner cup extending downwardly into said conical side portion.

8. The shipping container of claim 6 wherein a separator is positioned on the lower packages of yarn to permit a second layer of yarn packages to be positioned randomly thereon.

* * * * *